US005519290A

United States Patent [19]

Sugawara et al.

[11] Patent Number: 5,519,290

[45] Date of Patent: May 21, 1996

[54] COLOR CATHODE RAY TUBE APPARATUS

[75] Inventors: Shigeru Sugawara, Saitama; Junichi Kimiya, Fukaya, both of Japan

[73] Assignee: Kabushiki Kaisha Toshiba, Kawasaki, Japan

[21] Appl. No.: 509,094

[22] Filed: Aug. 1, 1995

[30] Foreign Application Priority Data

Aug. 1, 1994 [JP] Japan ..... 6-179973
Aug. 4, 1994 [JP] Japan ..... 6-183381

[51] Int. Cl.[6] ..... H01J 29/58

[52] U.S. Cl. ..... 315/382.1; 315/15

[58] Field of Search ..... 315/382, 382.1, 315/14, 15

[56] References Cited

U.S. PATENT DOCUMENTS 4,814,670 3/1989 Suzuki et al. ..... 315/15
4,945,284 7/1990 Shimoma et al. .
5,449,983 9/1995 Sugawara et al. ..... 315/382

FOREIGN PATENT DOCUMENTS 61-99249 5/1986 Japan .
1-232643 9/1989 Japan .

*Primary Examiner*—Theodore M. Blum
*Attorney, Agent, or Firm*—Cushman Darby & Cushman

[57] ABSTRACT

A seventh grid applied with an anode high voltage, a sixth grid applied with a dynamic voltage, and a fifth grid are provided in a main electron lens section of an electron gun. The dynamic voltage is obtained by superimposing a DC voltage lower than the anode high voltage by a voltage which changes in synchronization with deflection of electron beams. The fifth grid is connected to the sixth grid through a resistor device provided in the tube so as to be adjacent to the sixth grid in the side of the electron beam generator section. The fifth grid and the sixth grid form a multi-pole lens for correcting deflection aberration within the focus lens region of the main electron lens section. As a result, the withstanding voltage of the electron gun using a dynamic focusing method, the resolution of the color cathode ray tube apparatus, and the reliability are improved.

16 Claims, 6 Drawing Sheets

COLOR CATHODE RAY TUBE APPARATUS

BACKGROUND OF THE INVENTION

1. Field of the Invention

The present invention relates to a color cathode ray tube apparatus, and particularly, to a color cathode ray tube apparatus of a dynamic focus type which corrects a deflection aberration caused by a magnetic field generated by a deflection yoke.

2. Description of the Related Art

In general cases, a color cathode ray tube apparatus has an envelope consisting of a panel 1 and a funnel 2 integrally connected with this panel 1. A fluorescent screen 3 is formed on the stripe-like or dot-like three-color fluorescent material layers which irradiate blue, green, and red light rays, and a shadow mask 4 provided with a number of apertures is attached inside the screen 3, such that the mask faces the screen 3. On the other hand, an electron gun which emits three electron beams 6B, 6G, and 6R is provided in the neck 5 of the funnel 2. In addition, a deflection yoke 8 for generating horizontal and vertical deflection magnetic fields is provided outside the funnel 2. Further, the three electron beams 6B, 6G, and 6R are deflected by the horizontal and vertical deflection magnetic field in the direction toward the fluorescent screen 3 through the shadow mask 4. The fluorescent screen 3 is scanned by electron beams 6B, 6G, and 6R to display a color image.

This kind of color cathode ray tube apparatus particularly uses an electron gun 7 as an in-line type electron gun which emits three electron beams 6B, 6G, and 6R arranged in one line and extending on one same vertical plane. Meanwhile, an in-line type color cathode ray tube apparatus using a self-convergence method in which three electron beams 6B, 6G, and 6R arranged in line are subjected to self-concentration has been widely practiced, with a horizontal deflection magnetic field of a pin-cushion type and a vertical deflection magnetic field of a barrel type being generated.

Conventionally, this kind of electron gun 7 comprises a cathode which controls electron emission therefrom and focuses emitted electrons to form three electron beams 6B, 6G, and 6R, an electron beam generator section consisting of a plurality of electrodes arranged in order next to the cathode, and main electron lens section consisting of a plurality of electrodes which focuses the three electron beams 6B, 6G, and 6R obtained from the electron beam generator section onto a fluorescent screen 3.

In the color cathode ray tube apparatus stated above, it is necessary to appropriately focus three electron beams 6B, 6G, and 6R emitted from the electron gun 7, in order to attain good image characteristics on the fluorescent screen 3. However, three electron beams 6B, 6G, and 6R are subjected to astigmatic aberration in case where a horizontal deflection magnetic field of a pin-cushion type and a vertical deflection magnetic field of a barrel type are used as non-uniform magnetic fields which deflect three electron beams 6B, 6G, and 6R emitted from the electron gun 7, like in a color cathode ray tube apparatus of an in-line type using the self-convergence method. To explain this case with respect to the vertical deflection magnetic field of a pin-cushion type, for example, electron beams 6 (6B, 6G, and 6R) are influenced under forces in the arrow directions 11H and 11V applied by the vertical deflection magnetic field 10, as is shown in FIG. 2A, and the beam spot 12 on a peripheral portion of the fluorescent screen is influenced by deflection aberration and is remarkably deformed. The deflection aberration which influences the electron beams is caused since electron beams are excessively focused in the vertical direction, and a large halo (or bleeding) 13 appears in the vertical direction. The deflection aberration which influences the electron beams becomes larger as the tube has a larger size and as the deflection angle becomes larger, thereby remarkably deteriorating the resolution at the periphery of the fluorescent screen.

Japanese Patent Application KOKAI publication No. 61-99249 (corresponding to U.S. Pat. No. 4,814,670) discloses an electron gun which solves the problem of deterioration in resolution due to deflection aberration. These publications disclose electron guns having a basic structure illustrated in FIG. 3A. Specifically, each of those electron guns has first to fifth grids G1 to G5, and comprises an electron beam generator section GE, 4-pole element lens Q1, and a final focusing lens EL which are formed along the extending direction of the electron beams. The 4-pole lens QL of each electron gun is formed by in such a manner in which three non-circular electron beam through-holes 14*a*, 14*b*, and 14*c* as well as 15*a*, 15*b*, and 15*c* are formed in each of opposing surfaces of third and fourth grids G3 and G4.

The correction of deflection aberration incurred by the electron gun is expressed in an equivalent value using an optical lens, as shown in FIG. 4. Specifically, an electron gun is an electron gun of a dynamic focus method in which a 4-pole lens QL and a final focus lens EL are formed in order in the direction from the cathode K toward the fluorescent screen. In case of this electron gun, potentials at the third and fourth grids are substantially equalized to each other during non-deflection in which electron beams 6 from the cathode K land on the center of the fluorescent screen 3 so that the 4-pole lens QL does not substantially operate, while the electron beams 6 are appropriately focused on the center of the fluorescent screen 3 by the final focus lens EL, as indicated by continuous lines in the figure. On the contrary, the potential of the fourth grid is raised to form a 4-pole lens QL during deflection, so that the beams are diverged in the vertical direction and are focused in the horizontal direction. Simultaneously, the focusing effects are weakened in the vertical and horizontal directions. As a result of this, the electron beams 6 are insufficiently focused in the vertical direction, while the beams are influenced by the deflection aberration, i.e., focusing effects due to astigmatic aberration so that the beams are appropriately focused. Meanwhile, the total focusing in the horizontal direction are not substantially changed due to focusing effects of the 4-pole lens QL and reductions in focusing effects of the final focus lens EL, so that focusing is slightly insufficient. However, since the peripheral portion of the fluorescent screen 3 which the electron beams 6 reach is more distant from the electron gun than the center portion, the beams are appropriately focused in the vertical direction.

Thus, a color cathode ray tube apparatus which deflects three electron beams arranged in line and generated from the electron gun by means of non-uniform magnetic fields generated by the deflection yoke is influenced by astigmatic aberration due to the non-uniform magnetic fields, so that the beam spot in the peripheral portion of the fluorescent screen is deformed. The deflection aberration which influences the electron beams increases as the tube has a larger size and as the deflection angle becomes large, so that the resolution at the peripheral portion of the fluorescent screen is remarkably deteriorated. As an electron gun which solves the problem of deterioration in resolution, there has been a proposal of an electron gun of a dynamic focus method comprising electrodes consisting of first to fifth grids, as well as, an electron beam generator section, a 4-pole lens, and a final focusing lens which are formed in order in the direction from the cathode toward the fluorescent screen.

However, in this kind of electron gun using a dynamic focus method, since the third and fourth grids must be supplied with two kinds of middle voltages of 5 to 10 kV, there is a problem of withstanding voltages in a voltage supply section. In addition, since the connection lines for applying respective electrodes with predetermined voltages must be long, there are problems, e.g., the withstanding voltages in the tube are decreased and the focusing characteristics of the electron beams are deteriorated due to discharges and leakage currents.

In this respect, Japanese Patent Application KOKAI Publication No. 1-232643 (corresponding to U.S. Pat. No. 4,945,284) discloses an electron gun in which two adjacent grids among a plurality of grids are connected by a resistor device provided in the tube, with one of these two grid which is adjacent to the final acceleration electrode being applied with a dynamic voltage, and the other being applied with the dynamic voltage through a resistor device, thereby to attain only one kind of middle voltage supplied from outside the tube.

However, the resistance value of this resistor device is conventionally about 200 kΩ, and sufficient consideration has not been taken with respect to setting of this resistance value. Specifically, when a disclosed resistance value of 200 kΩ is used, a potential difference does not occur between two electrodes connected by a resistor device and a multi-pole lens which will correct astigmatic aberration of the deflection magnetic field is not formed, even if a dynamic focus voltage is applied. Therefore, there is a problem that correction of astigmatic aberration is difficult.

SUMMARY OF THE INVENTION

The object of the present invention is to provide a color cathode ray tube apparatus which attains high resolution throughout the entire screen area, and which ensures excellent withstanding voltage characteristics of an electron gun and high reliability, wherein a multi-pole lens for generating a potential difference between two electrodes connected by a resistor device is effectively formed to correct astigmatic aberration of a deflection magnetic field.

The present invention provides a color cathode ray tube apparatus at least comprising: an electron gun having a main electron lens section formed by a plurality of grids for focusing at least one electron beam emitted from an electron beam generator section; and a deflection yoke for generating a magnetic field for deflecting the electron beam thereby to scan a target with the beam, wherein the electron gun consists of at least one cathode and a plurality of grids, at least adjacent two of the plurality of grids are connected by a resistor device arranged in a tube, a round electron beam through-hole is formed in each of opposing surfaces of the adjacent grids, and at least one of the adjacent grids is applied with a dynamic voltage which changes in synchronization with deflection of the electron beams.

Further, in the color cathode ray tube apparatus according to the present invention, the plurality of grids of the electron gun at least consist of first to fourth grids arranged orderly from the cathode side toward the target side, the first to third grids are adjacent to each other, the fourth grid is applied with an anode high voltage, the third grid is applied with a dynamic voltage obtained by superimposing a DC voltage lower than the anode high voltage by a voltage which changes in synchronization with deflection of the electron beam, the first grid is applied with a voltage lower than the voltage applied to the second grid, multi-pole lens formation means for correcting deflection aberration is provided between the second and third grids, and a following relation is satisfied where an electrostatic capacitance between the third and second grids is expressed by Ca, an electrostatic capacitance between the second and first grids is expressed by Cb, a resistance value of the resistor device is expressed by R, a frequency of the dynamic voltage synchronized with vertical deflection is expressed by fH, and a number π expresses a ratio of the circumference of a circle to its diameter:

$$\pi^2 \cdot fH \cdot Ca \cdot R \geqq 13 \cdot (1-\gamma)$$

where an equation of $\gamma = Ca/(Ca+Cb)$ is satisfied.

In addition, in the color cathode ray tube apparatus of the present invention, the plurality of grids of the electron gun at least consist of first to seventh grids arranged orderly in a direction from the cathode to the target, the first to sixth grids are adjacent to each other, the seventh grid is applied with an anode high voltage, the six grid is applied with a dynamic voltage obtained by superimposing a DC voltage lower than an anode high voltage by a voltage which changes in synchronization with deflection of the electron beam, the fifth grid is connected to the sixth grid at least through a resistor device arranged in the tube, and multi-pole lens formation means for correcting deflection aberration is provided between the fifth and sixth grids, the fourth grid is applied with a voltage lower than the voltage applied to the sixth grid, the fourth grid is connected to the second grid within the tube, the first grid is applied with a voltage lower than the voltage applied to the fourth grid, and a following relation is satisfied where an electrostatic capacitance between the sixth and fifth grids is expressed by Ca, an electrostatic capacitance between the fifth and fourth grids is expressed by Cb, a resistance value of the resistor device is expressed by R, a frequency of a dynamic voltage synchronized with vertical deflection is expressed by fH, and a number π is a ratio of the circumference of a circle to its diameter:

$$\pi^2 \cdot fH \cdot Ca \cdot R \geqq 13 \cdot (1-\gamma)$$

where an equation of $\gamma = Ca/(Ca+Cb)$ is satisfied.

Further, in the color cathode ray tube apparatus according to the present invention, the plurality of grids of the electron gun at least consist of first to fourth grids arranged orderly from the cathode side toward the target side, the first to third grids are adjacent to each other, the second and third grids are connected to each other by a first resistor device, the third and fourth grids are connected to each other by a second resistor device connected to the first resistor device, the first grid is applied with a predetermined voltage, the fourth grid is applied with an anode high voltage, the third grid is externally connected with voltage supply means and is applied with a dynamic voltage which changes in synchronization with deflection of the electron beam, multi-pole lens formation means for correcting deflection aberration is provided between the second and third grids, and a following relation is satisfied where an electrostatic capacitance between the third and second grids is expressed by Ca, an electrostatic capacitance between the second and first grids is expressed by Cb, a resistance value of the resistor device is expressed by R, a frequency of the dynamic voltage synchronized with vertical deflection is expressed by fH, and a number π expresses a ratio of the circumference of a circle to its diameter:

$$\pi^2 \cdot fH \cdot Ca \cdot R \geqq 13 \cdot (1-\gamma)$$

where an equation of $\gamma = Ca/(Ca+Cb)$ is satisfied.

In addition, in the color cathode ray tube apparatus of the present invention, the plurality of grids of the electron gun at least consist of first to fifth grids arranged orderly in a direction from the cathode to the target, the first to third grids are adjacent to each other, the second and third grids are connected by a first resistor device, the third and fourth grids are connected by a second resistor, the fourth and fifth grids are connected by a third resistor, the first grid is applied with a predetermined voltage, the fifth grid is applied with an anode high voltage, the third grid is externally connected with voltage supply means and is applied with a dynamic voltage which changes in synchronization with deflection of the electron beam, multi-pole lens formation means for correcting deflection aberration is provided between the second and third grids, and a following relation is satisfied where an electrostatic capacitance between the sixth and fifth grids is expressed by Ca, an electrostatic capacitance between the fifth and fourth grids is expressed by Cb, a resistance value of the resistor device is expressed by R, a frequency of a dynamic voltage synchronized with vertical deflection is expressed by fH, and a number $\pi$ is a ratio of the circumference of a circle to its diameter:

$$\pi^2 \cdot fH \cdot Ca \cdot R \geqq 13 \cdot (1-\gamma)$$

where an equation of $\gamma = Ca/(Ca+Cb)$ is satisfied.

According to the above structure, in a period where the electron beams is horizontally deflected, it is possible to satisfy the relation:

$$2\pi \cdot fH \cdot Ca \cdot R >> 1$$

and to divide and reduce the dynamic voltage by using the electrostatic capacitance Ca between the second and third grids and the electrostatic capacitance Cb between the first and second grids, such that a divided voltage is alternately applied to the second grid. As a result of this, the potential difference between the second and third grids becomes large in accordance with horizontal deflection of the electron beam, a multi-pole lens formed by the second and third grids is intensified in accordance with horizontal deflection of the electron beam. Simultaneously, the focusing effects of the final focus lens are weakened. Non-point aberration of the horizontal deflection magnetic field can be corrected.

As a result, astigmatic aberration can be corrected only by supplying the electron gun with a middle voltage from outside the tube, and it is possible to provide a high performance color cathode ray tube apparatus which ensures high resolution throughout the entire screen, excellent withstanding voltage characteristics, and high reliability. In addition, the middle voltage stated above is supplied by a resistor device provided outside the tube, and therefore, circuit costs of the color cathode ray tube apparatus can be greatly reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

In the following, the color cathode ray tube apparatus will be explained with reference to the drawings.

Figure 1:
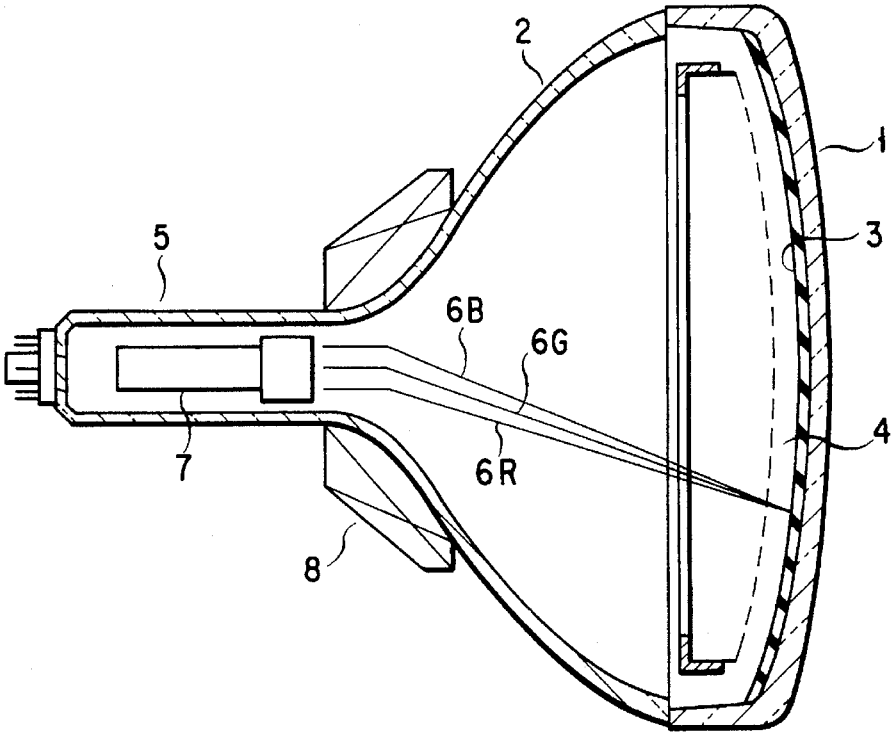
FIG. 1 is a cross-section schematically showing the structure of a conventional color cathode ray tube apparatus.
Figure 2A:
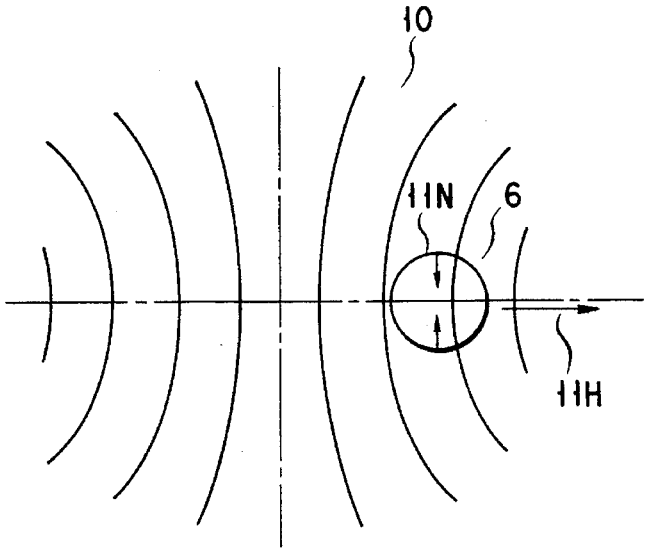
FIGS. 2A and 2B respectively are a view for explaining operation of a pin-cushion type horizontal deflection magnetic field with respect to an electron beam, and a view for explaining the shape of a beam spot on the fluorescent screen generated by the operation.
Figure 2B:
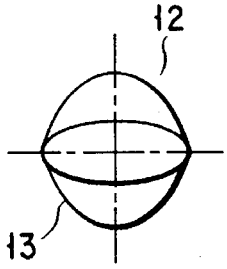
Figure 3A:
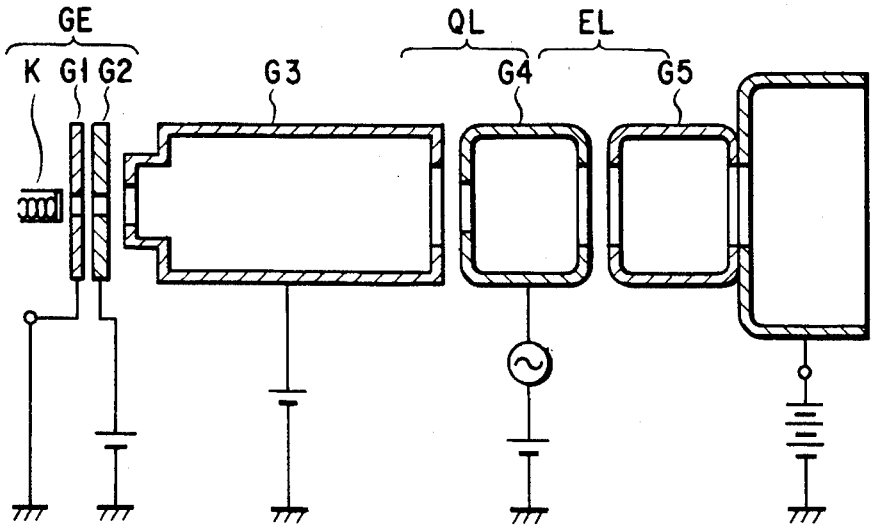
FIGS. 3A, 3B, and 3C are respectively a view schematically showing the structure of a conventional improved electron gun, a plan view showing the shapes of electron beam through-holes formed in the surface of the third grid opposing the fourth grid, and a plan view showing the shapes of electron beam through-holes formed in the surface of the fourth grid opposing the third grid.
Figure 3B:
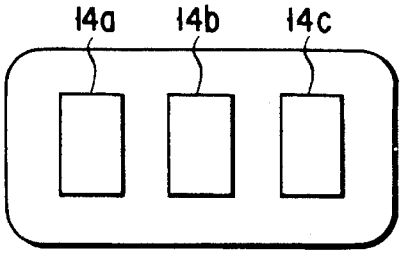
Figure 3C:
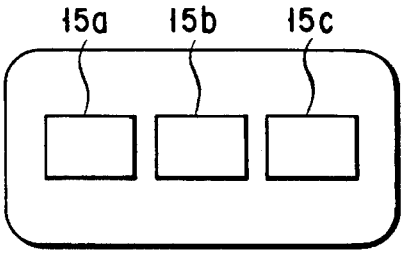
Figure 4:
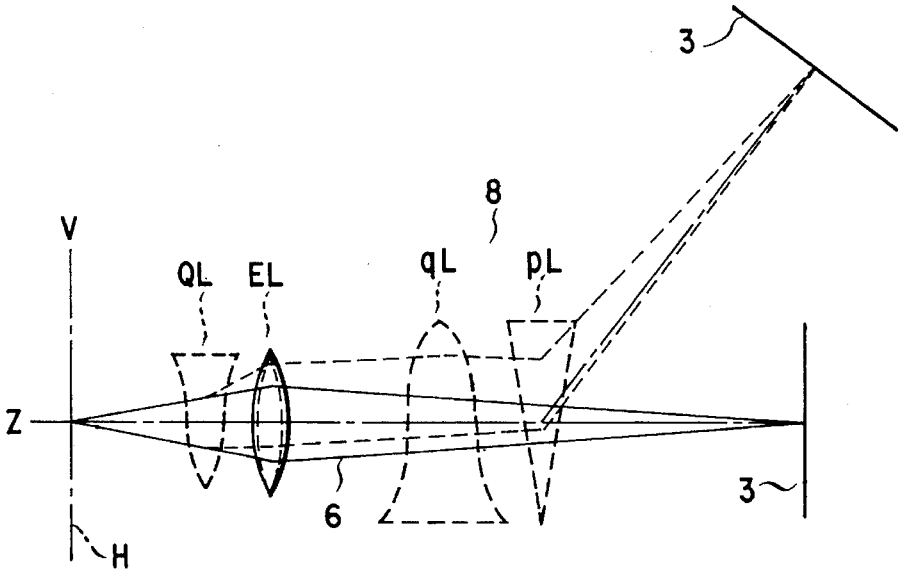
FIG. 4 explains operation of a main electron lens section of the electron gun shown in FIG. 3A.
Figure 5:
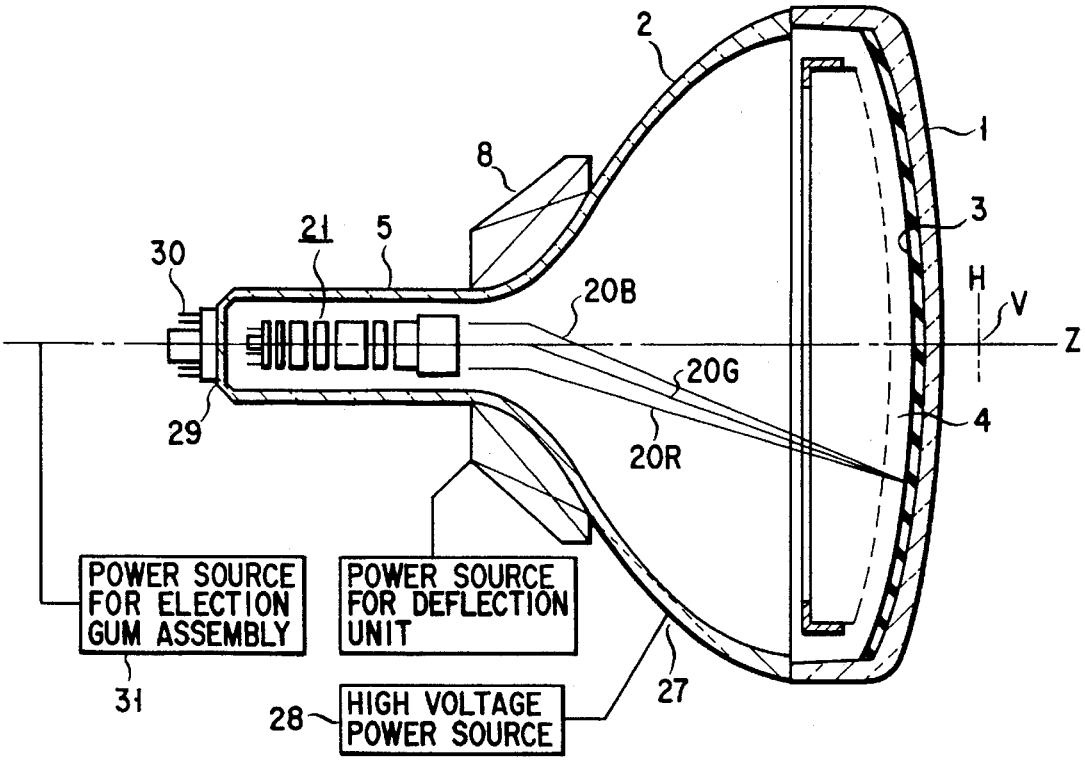
FIG. 5 is a cross-section schematically showing the structure of a color cathode ray tube apparatus according to an embodiment of the present invention.

FIG. 5 schematically shows the color cathode ray tube apparatus according to an embodiment of the present invention. This color cathode ray tube apparatus has a panel 1 and an envelope consisting of a funnel integrally connected with the panel 1. A fluorescent screen 3 formed of a stripe-like three-color fluorescent layer which emits blue, green, and red lights is formed on the inner surface of the panel 1, and a shadow mask 4 having a number of apertures formed is attached to the inner side of the mask. Meanwhile, an electron gun 21 for emitting three electron beams 20B, 20G, and 20R arranged in line and extending on one same horizontal plane is provided within a neck 5 of the funnel 2.

In addition, a deflection yoke 8 which generates horizontal and vertical magnetic fields is attached to the outside of the funnel 2. Further, the three electron beams 20B, 20G, and 20R emitted from the electron gun 21 are deflected by the horizontal and vertical deflection magnetic fields, to be directed toward the fluorescent screen 3 through the shadow mask 4. The fluorescent screen 3 is horizontally and vertically scanned with three electron beams 20B, 20G, and 20R, thereby displaying a color image.

Figure 6:
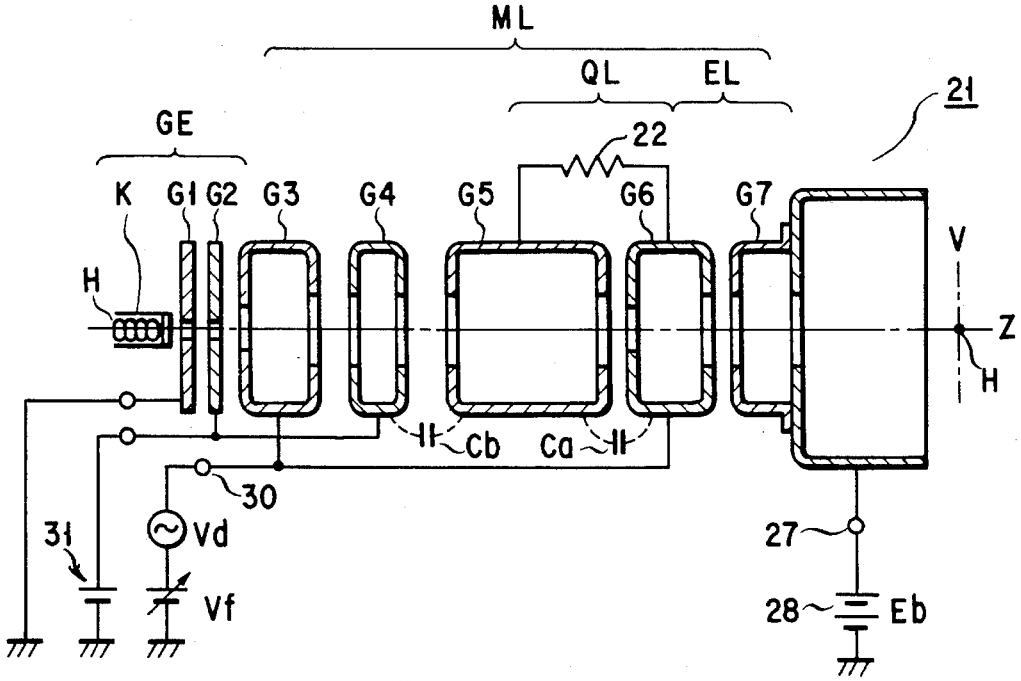
FIG. 6 is a view schematically showing the structure of the electron gun used in the color cathode ray tube apparatus.

The electron gun 21 comprises three cathodes K disposed in line in the horizontal direction (i.e., the axis H direction) as shown in FIG. 6, a heater H for individually heating the cathodes K, and first to seventh grids G1 to G7 disposed orderly at a predetermined interval in the direction from the cathode toward the fluorescent screen. The fifth grid G5 and the sixth grid G6 are electrically connected with each other through a resistor device 22 provided in the tube.

Figure 7A:
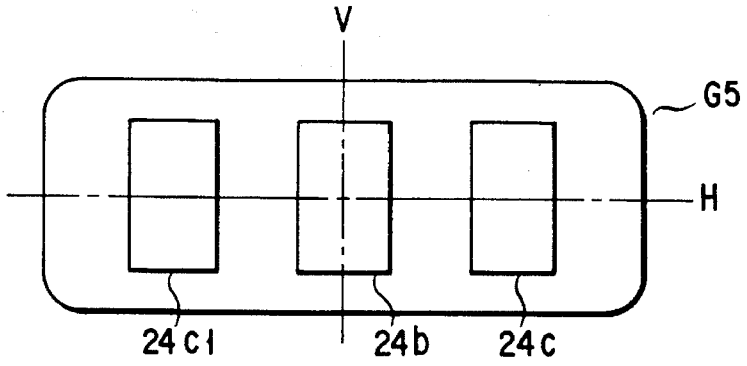
FIGS. 7A and 7B are respectively a plan view showing the shapes of electron beam through-holes formed in the surface of the fifth grid opposing the sixth grid, shown in FIG. 6, and a plan view showing the shapes of electron beam through-holes formed in the surface of the sixth grid opposing the fifth grid.
Figure 7B:
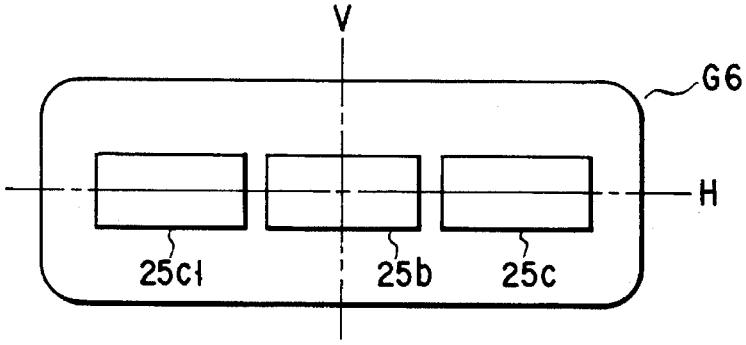

The first and second grids G1 and G2 are formed of plate-like electrodes, and three round beam through-holes having relatively small sizes are arranged in line on the surfaces of the plate-like electrodes so as to correspond to the three cathodes K. Each of the third to sixth grids G3 to G6 is formed of a cylindrical electrode, and three substantially round through-holes having a size larger than the size of electron beam through-holes of the second grid G2 are formed in line in the surface of the third grid G3 opposing the second grid G2. In addition, three substantially circular electron beam through-holes having a size much larger than the electron beam through-holes of the surface of the third grid G3 opposing the second grid G2 are provided so as to correspond to the three cathodes K, in each of the surface of the third grid G3 opposing the fourth grid G4, the surfaces of the fourth grid G4 respectively opposing the third and fifth grids G3 and G5, the surface of the fifth grid G5 opposing the fourth grid G4, and the surface of the sixth grid G6 opposing the seventh grid G7. Further, three electron beam through-holes 24*a*, 24*b*, and 24*c* each having a longer diameter in the vertical direction (or V-axis direction) and a shape substantially elongated in the longitudinal direction are provided in line in the surface of the fifth grid G5 opposing the sixth grid G6, so as to correspond to the three cathodes, as shown in FIG. 7A. On the other hand, three electron beam through-holes 25*a*, 25*b*, and 25*c* each having a longer diameter in the horizontal direction and elongated in the lateral direction are provided in line in the surface of the sixth grid G6 opposing the fifth grid G5, so as to correspond to the three cathodes K, as shown in FIG. 7B. The seventh grid G7 is formed of a cup-like electrode, and three electron beam through-holes each having the same size as the electron beam through-holes of the surface of the sixth grid G6 opposing the seventh grid G7 and a substantially circular shape are formed in line in the surface of the grid G7 opposing the sixth grid G6, so as to correspond to the three cathodes.

In this electron gun 21, electron emission from the cathodes K is controlled by the cathodes K and the first to third grids G1 to G3, and an electron beam generator section GE for forming electron beams by accelerating and focusing electrons thus emitted is formed. The third to seventh grids G3 to G7 constitute a main electron lens section ML for focusing the electron beams onto the fluorescent screen. In this main electron lens section ML, a multi-pole lens QL is formed between the fifth grid provided with the electron beam through-holes 24*a*, 24*b*, and 24*c* each substantially elongated in the longitudinal direction and the sixth grid G6 having electron beam through-holes 25*a*, 25*b*, and 25*c* each substantially elongated in the lateral direction, and a final focus lens EL is formed between the sixth grid G6 and the seventh grid G7.

In this kind of electron gun 21, the seventh grid G7 is applied with an anode high voltage Eb of 25 to 35 kV through the anode terminal 27 provided in the funnel. In addition, the sixth grid G6 and the third grid G3 are connected to each other within the tube, and these third and sixth grids G3 and G6 are applied with a dynamic focus voltage obtained by superimposing a reference voltage Vf by a parabola-like voltage Vd which changes in synchronization with deflection of the electron beams, wherein the reference voltage Vf is set to a DC voltage of 20 to 30% of the anode high voltage Eb supplied from an electron gun power source 31 through a stem pin 30 air-tightly penetrating a step 29 of the neck end portion shown in FIG. 5. The fifth grid G5 connected to the sixth grid G6 through a resistor device 22 is applied with a voltage which will be described later. Further, the second grid G2 and the fourth grid G4 are connected to each other within the tube, and are supplied with a cut-off voltage of 500 to 1000 V from the electron gun power source 31 through a stem pin 29 air-tightly penetrating the stem 28. The first grid G1 is grounded, and the cathodes K are supplied with a voltage obtained by superimposing a DC voltage of 100 to 200 V by a video signal, from the electron gun power source 31.

With respect to fifth grid 5, at least a DC voltage component of the voltage applied to the sixth grid G6 by the resister device 22 is supplied, this component is electrostatically connected with the sixth grid G by the electrostatic capacitance Ca between the opposing surface of the fifth grid G5 and the sixth grid G6, and the voltage obtained by superimposing an AC voltage component of the dynamic focus voltage inducted by the electrostatic capacitance Ca is applied as the voltage to the fifth grid 5.

Figure 8:
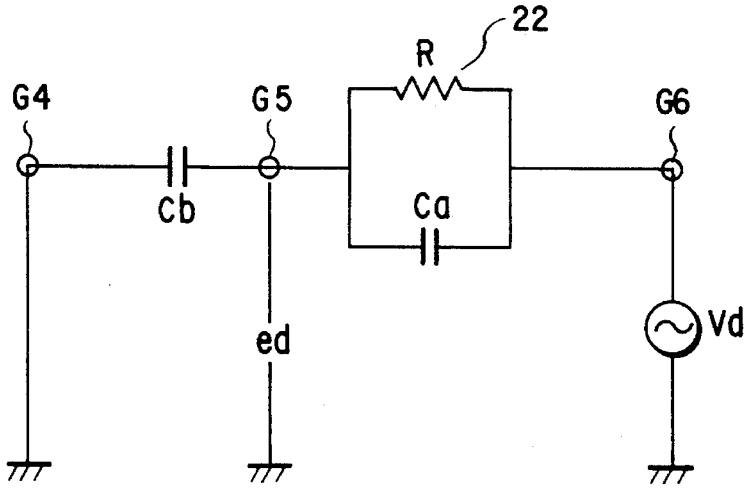
FIG. 8 is an electrically equivalent circuit diagram of the fourth, fifth, and sixth grids shown in FIG. 6.

As shown as the electrically equivalent circuit configuration of FIG. 8, the AC voltage component ed applied to the fifth grid G5 is expressed by the following mathematical formula 1, where the resistance value of the resistor device 22 is R, the electrostatic capacitance between the opposing surfaces of the fifth grid G5 and the sixth grid G4 is Ca,the electrostatic capacitance between the opposing surfaces of the fifth grid G5 and the fourth grid G4 is Cb, the dynamic focus voltage applied to the sixth grid G6 is Vd, the frequency thereof is f, the phase difference thereof is $\phi$, and the ratio of circumference of a circle to its diameter is $\pi$, and where the following equations are satisfied:

$$\omega=2\pi f$$

$$j^2=-1$$

Thus, the AC voltage component ed is expressed by following mathematic formula 1:

$$ed=\sqrt{\frac{1+(\omega\tau)^2}{1+\left(\frac{\omega\tau}{\gamma}\right)^2}}\cdot Vd\cdot\exp(\phi)$$

where $\tau=R\cdot Ca$ $$\gamma=Ca/(Ca+Cb)$$

The phase difference $\phi$ is expressed by the mathematical formula 2 as follows:

$$\phi = \tan^{-1}\frac{-\omega\tau\left(\frac{1-\gamma}{\gamma}\right)}{1+\frac{(\omega\tau)^2}{\gamma}}$$

Note that the sizes of the electrostatic capacitances Ca and Cb are respectively decided by the distances opposing between the opposing grids G4 and G5 and the distance between the opposing grids G4 and G4, as well as by the areas of opposing surfaces. If the areas of these grids G4, G5, and G6 are substantially equal to each other, the phase difference is expressed by the following equation where the distance between the fifth grid G5 and the sixth grid G6 is expressed by ga and where the distance between the fourth grid G4 and the fifth grid G5 is expressed by gb.

$$\gamma = gb/(ga+gb)$$

Figure 9:
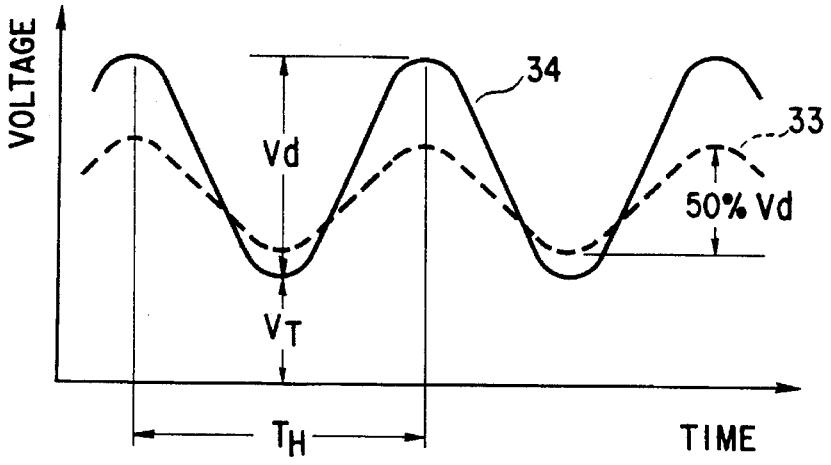
FIG. 9 is a view for explaining waveforms of voltages applied to the fifth and sixth grids of the electron gun shown in FIG. 6.

In the formula described above, the value of ·Ca·R, i.e., the value of 2π·f·Ca·R is changed depending of the frequency f of the dynamic focus voltage, and therefore, the voltage ed inducted by the fifth grid G5 can be appropriately set by means of the horizontal deflection frequency fH by properly selecting the electrostatic capacitance Ca and the resistance value R. Specifically, it is possible to correct astigmatic aberration of the deflection magnetic field, by providing a potential difference between the fifth grid G5 and the sixth grid G6, thereby to form a multi-pole lens therebetween.

$$2\pi \cdot fH \cdot Ca \cdot R >> 1$$

Where this relation is satisfied, the fifth grid G5 can be applied with a voltage obtained by superimposing the AC voltage component Vd of the dynamic focus voltage applied to the sixth grid G6 by about γ (=Ca/(Ca+Cb). For example, in case where Ca=Cb is satisfied, 50% of the parabola-like voltage Vd (which will be referred to as 50% Vd) which changes in synchronization with deflection of the electron beam can be superimposed to the electrode of the fifth grid, as shown in FIG. 9, so that the voltage of the fifth grid G5 can be changed in synchronization with the dynamic focus voltage applied to the sixth grid G6 as indicated by a curve 34, as indicated by a curve 33, to increase the potential difference between the fifth grid G5 and the sixth grid G6 in accordance with deflection of the electron beam. As apparent from the curves shown in FIG. 9, the potential Vd of the fifth grid G5 is lower than the potential VT of the sixth grid G6, when the electron beams are directed to a center region of the screen 3. However, the potential Vd of the fifth grid G5 is gradually increased in accordance to the horizontal deflection of the electron beams and is higher than the potential VT of the sixth grid G6 when the electron beams are deflected to a pheripheral region of the screen 3. Thus, a multi-pole lens for correcting the deflection aberration is formed between the fifth and sixth grids G5, G6 to which the voltages Vd, Vt shown in FIG. 9 are applied.

Consequently, if the resistance value R, the electrostatic capacitance between the electrodes, and the frequency f of the dynamic voltage are selected as described above, and if the opposing beam through-holes of the fifth and sixth grids G5 and G6 are respectively shaped as shown in FIGS. 7A and 7B, the horizontal focusing effect and vertical diverging effect of a multi-pole lens formed between the fifth and sixth grids G5 and G6 can be increased in accordance with deflection of the electron beam, while simultaneously weakening the focusing effect of the final focus lens EL, thereby to correct astigmatic aberration of the horizontal deflection magnetic field. Note that TH denotes one cycle of horizontal deflection.

In case of an actual color cathode ray tube, since overscanning is performed so as to scan a range wider by 4 to 8% than an image forming range of the screen, the phase difference of about 4π/104 rad must be permitted. Therefore, taking into consideration this phase difference, the following relation exists.

$$\pi^2 \cdot fH \cdot Ca \cdot R \leqq 13 \cdot (1-\gamma)$$

It is required to only satisfy the following condition:

$$R \leqq 13 \cdot (1-\gamma)/(\pi^2 \cdot fH \cdot Ca)$$

Hence, in case of a color cathode ray tube apparatus adopted in a TV receiver set using an NTSC method, since the electrostatic capacitance between the electrodes is about 2 pF, an equation of Ca=Cb=2 pF is satisfied. The horizontal deflection frequency fH adopted in this color cathode ray tube apparatus is 15.75 kHz, a relation of R≦20.9 MΩ is satisfied. As a result, if the resistance value of the resistor device which connects the fifth grid G5 and the sixth grid G6 to each other is set to 20.9 MΩ or more, the problem of practical phase difference can be solved, so that 50% of the dynamic focus voltage applied to the sixth grid G6 can be inducted to the fifth grid G5.

Note that although the above embodiment defines Ca=Cb, the present invention is applicable where values of Ca and Cb are adjusted within a range for practical use, the rate of superimposing is set.

Meanwhile, a color cathode ray tube apparatus used as a display in a personal computer set also adopts an electrostatic capacitance of about 2 pF between electrodes, and therefore, Ca=Cb=2 pF is obtained. Further, since the horizontal deflection frequency fH adopted in this color cathode ray tube is 64 kHz, the following relation is obtained.

$$R \leqq 5.1\ M\Omega$$

If the resistance value R of the resistor device 22 connecting the fifth grid G5 and the sixth grid G6 to each other is set to 5.1 MΩ or more, the problem of practical phase difference can be solved, so that 50% of the dynamic focus voltage applied to the sixth grid G6 can be inducted to the fifth grid G5.

Further, it is expected that a color cathode ray tube apparatus will adopt a higher horizontal deflection frequency fH in the future than in today, this frequency is limited to 120 kHZ at most. Supposing that the electrostatic capacitance between electrodes is about 2 pF under this condition, the following is obtained.

$$R \leqq 2.0\ M\Omega$$

If the resistance value R of the resistor device 22 connecting the fifth grid G5 and the sixth grid G6 to each other is set to 5.1 MΩ or more, the problem of practical phase difference can be solved in the future, so that 50% of the dynamic focus voltage applied to the sixth grid G6 can be inducted to the fifth grid G5.

Figure 10:
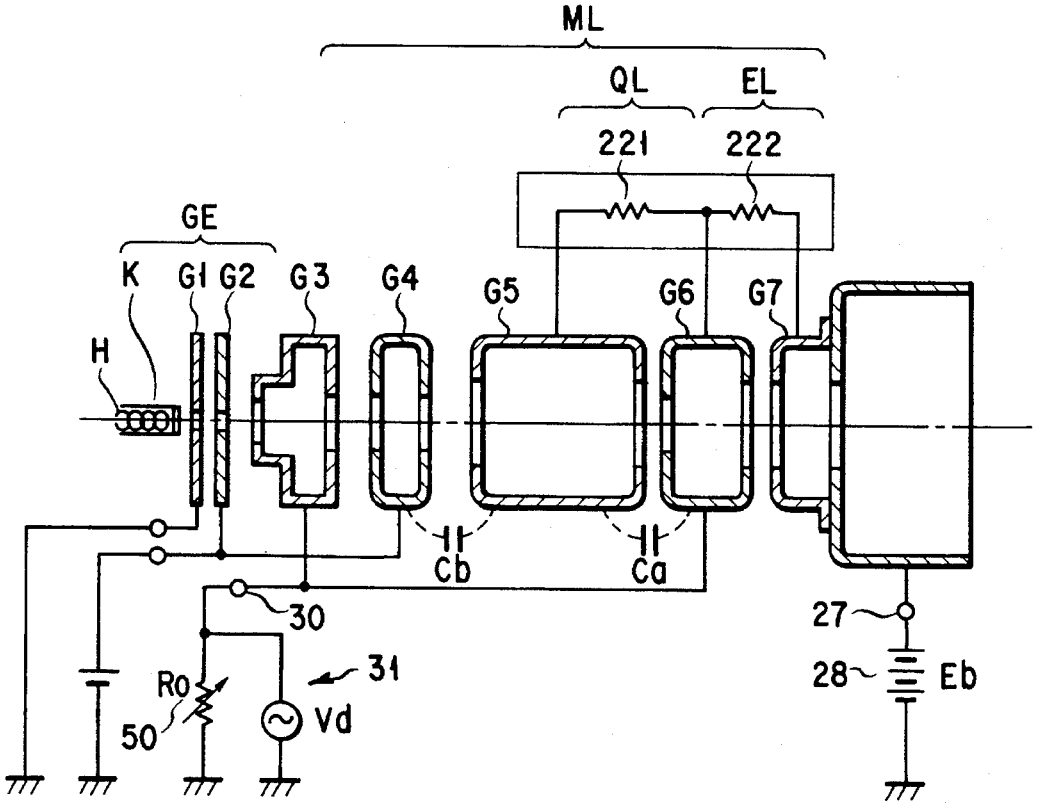
FIG. 10 is a view schematically showing the structure of an electron gun according to another embodiment of the present invention.

Another embodiment of a color cathode ray tube apparatus according to the present invention will be explained in the next. In this embodiment, an electron gun 21 comprises three cathodes K disposed in line in the horizontal direction (i.e., the H-axis direction) as shown in FIG. 10, a heater H for individually heating the cathodes K, and first to third grids G1 to G3, a fourth grid G4, a fifth grid G5, and a sixth grid G6, and a seventh grid G7 which are disposed orderly at a predetermined interval in the direction from the cathode toward the fluorescent screen. The fifth grid G5 and the sixth grid G6 are electrically connected with each other through a first resistor device 221 provided in the tube. The sixth grid G6 and the seventh grid G7 are connected with each other through a second resistor device 222 which is provided close to the electron gun in the tube and connected in serial with the first resistor device 221. Further, the sixth grid G6 is electrically connected to an end of a variable resistor device 50 provided outside the tube through a stem pin 20 air-tightly penetrating a stem 29 at a neck end portion shown in FIG. 5. Another end of this apparatus is grounded.

The first and second grids G1 and G2 are formed of plate-like electrodes, and three beam through-holes each having a relatively small size and a substantially circular shape are provided in line in the surfaces of the plate-like electrodes so as to correspond to the three cathodes K.

Each of the third to seventh grids G3 to G7 is formed of a cylindrical electrode, and three substantially circular through-holes having a size larger than the size of the electron beam through-holes of the second grid G2 are formed in line in the surface of the third grid G3 opposing the second grid G2. In addition, three substantially circular electron beam through-holes each having a size larger than the electron beam through-holes of the surface of the third grid G3 opposing the second grid G2 are provided so as to correspond to the three cathodes K, in each of the surface of the third grid G3 opposing the fourth grid G4, the surfaces of the fourth grid G4 respectively opposing the third and fifth grids G3 and G5. Also, three substantially circular electron beam through-holes each having a size same as or larger than the electron beam through-holes of the surface of the fourth grid G4 opposing the seventh grid G7 are provided so as to correspond to the three cathodes K, in each of the surface of the fifth grid G5 opposing the fourth grid G4, and the surface of the sixth grid G6 opposing the seventh grid G7. Further, three electron beam through-holes 24*a*, 24*b*, and 24*c* each having a longer diameter in the vertical direction (or V-axis direction) and a shape substantially elongated in the longitudinal direction are provided in line in the surface of the fifth grid G5 opposing the sixth grid G6, so as to correspond to the three cathodes, as shown in FIG. 7A. On the other hand, three electron beam through-holes 25*a*, 25*b*, and 25*c* each having a longer diameter in the horizontal direction and elongated in the lateral direction are provided in line in the surface of the sixth grid G6 opposing the fifth grid G5, so as to correspond to the three cathodes K, as shown in FIG. 7B.

In this electron gun 21, electron emission from the cathodes K is controlled by the cathodes K and the first to third grids G1 to G3, and an electron beam generator section GE for forming electron beams by accelerating and focusing electrons thus emitted is formed. The third to seventh grids G3 to G7 constitute a main electron lens section ML for focusing the electron beams onto the fluorescent screen. In this main electron lens section ML, a multi-pole lens QL is formed between the fifth grid G5 provided with the electron beam through-holes 24*a*, 24*b*, and 24*c* each substantially elongated in the longitudinal direction and the sixth grid G6 having electron beam through-holes 25*a*, 25*b*, and 25*c* each substantially elongated in the lateral direction, and a final focus lens EL is formed between the sixth grid G6 and the seventh grid G7.

In this kind of electron gun 21, the seventh grid G7 is applied with an anode high voltage Eb of 25 to 35 kV through the anode terminal 27 provided in the funnel. In addition, the third grid G3 and the sixth grid G6 are connected to each other within the tube, and these third and sixth grids G3 and G6 are applied with a dynamic focus voltage obtained by superimposing a reference voltage Vf by a parabola-like voltage Vd which changes in synchronization with deflection of the electron beams, wherein the reference voltage Vf is set to a DC voltage of 20 to 30% of the anode high voltage Eb, obtained by subjecting the anode high voltage Eb to resistance division by means of the second resistor device 222 connected to the sixth and seventh grids G6 and G7 and a variable resistor device 50 provided outside the tube. The fifth grid G5 connected to the sixth grid G6 through a first resistor device 221 is applied with a voltage which will be described later. Further, the second grid G2 and the fourth grid G4 are connected to each other within the tube, and are supplied with a cut-off voltage of 500 to 1000 V from the electron gun power source 31 through a stem pin 30 air-tightly penetrating the stem 29. The first grid G1 is grounded, and the cathodes K are supplied with a voltage obtained by superimposing a DC voltage of 100 to 200 V by a video signal, from the electron gun power source 31.

With respect to fifth grid 5, at least a DC voltage component of the dynamic focus voltage applied to the sixth grid G6 through the first resistor device 221 is supplied, this component is electrostatically combined with the sixth grid G by the electrostatic capacitance Ca between the opposing surface of the fifth grid G5 and the sixth grid G6, and the voltage obtained by superimposing an AC voltage component of the dynamic focus voltage inducted by the electrostatic capacitance Ca is applied as the voltage to the fifth grid 5.

Figure 11:
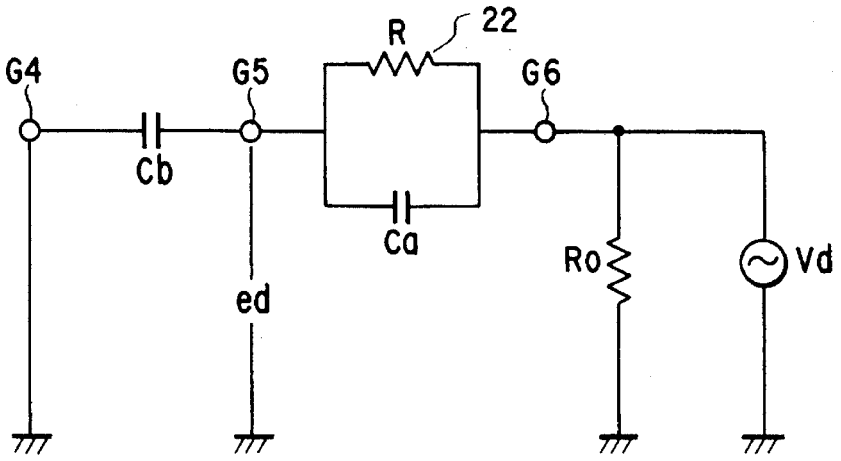
FIG. 11 is an electrically equivalent circuit diagram of the fourth, fifth, and sixth grids of the electron gun shown in FIG. 10.

As shown as the electrically equivalent circuit configuration of FIG. 11, the AC voltage component ed applied to the fifth grid G5 is expressed by the mathematical formula 1, where the resistance value of the first resistor device 221 is R, the electrostatic capacitance between the opposing surfaces of the fifth grid G5 and the sixth grid G6 is Ca,the electrostatic capacitance between the opposing surfaces of the fifth grid G5 and the fourth grid G4 is Cb, the dynamic focus voltage applied to the sixth grid G6 is Vd, the frequency thereof is f, the phase difference thereof is $\phi$, and the ratio of circumference of a circle to its diameter is $\pi$, and where the following equations are satisfied:

$$\omega=2\pi f$$

$$j^2=-1$$

The phase difference $\phi$ is expressed by the mathematical formula 2.

Note that the sizes of the electrostatic capacitances Ca and Cb are respectively decided by the distances opposing between the opposing grids G4 and G5 and the distance between the opposing grids G4 and G4, as well as by the areas of opposing surfaces. If the areas of these grids G4, G5, and G6 are substantially equal to each other, the phase difference is expressed by the following equation where the distance between the fifth grid G5 and the sixth grid G6 is expressed by ga and where the distance between the fourth grid G4 and the fifth grid G5 is expressed by gb.

$$\gamma=gb/(ga+gb)$$

In the formula described above, the value of ·Ca·R, i.e., the value of $2\pi\cdot f\cdot Ca\cdot R$ is changed depending of the frequency f of the dynamic focus voltage, and therefore, the voltage ed inducted by the fifth grid G5 can be appropriately set by means of the horizontal deflection frequency fH by properly selecting the electrostatic capacitance Ca and the resistance value R. Specifically, it is possible to correct astigmatic aberration of the deflection magnetic field, by providing a potential difference between the fifth grid G5 and the sixth grid G6, thereby to form a multi-pole lens therebetween.

$$2\pi \cdot fH \cdot Ca \cdot R >> 1$$

Where this relation is satisfied, the fifth grid G5 can be applied with a voltage obtained by super-imposing the AC voltage component Vd of the dynamic focus voltage applied to the sixth grid G6 by about $\gamma$ (=Ca/(Ca+Cb). For example, in case where Ca=Cb is satisfied, 50% of the parabola-like voltage Vd (which will be referred to as 50% Vd) which changes in synchronization with deflection of the electron beam can be superimposed to the electrode of the fifth grid, as shown in FIG. 9, so that the voltage of the fifth grid G5 can be changed in synchronization with the dynamic focus voltage applied to the sixth grid G6 as indicated by a curve 34, as indicated by a curve 33, to increase the potential difference between the fifth grid G5 and the sixth grid G6 in accordance with deflection of the electron beam.

Consequently, if the resistance value R, the electrostatic capacitance between the electrodes, and the frequency f of the dynamic voltage are selected as described above, and if the opposing beam through-holes of the fifth and sixth grids G5 and G6 are respectively shaped as shown in FIGS. 7A and &B, the horizontal focusing effect and vertical diverging effect of a multi-pole lens formed between the fifth and sixth grids G5 and G6 can be increased in accordance with deflection of the electron beam, while simultaneously weakening the focusing effect of the final focus lens EL, thereby to correct astigmatic aberration of the horizontal deflection magnetic field. Note that TH denotes one cycle of horizontal deflection.

This means that the focusing and diverging effects respectively created in the horizontal and vertical directions of the multi-pole lens formed between the fifth and sixth grids G5 and G6 can be increased in accordance with deflection of an electron beam while simultaneously weakening the focusing effect of the final focus lens EL, to correct astigmatic aberration of the vertical deflection magnetic field, like in the foregoing embodiment, where the following is satisfied.

$$2\pi \cdot fH \cdot Ca \cdot R >> 1$$

Hence, under the same setting condition as in the foregoing embodiment, the following relations are obtained.

$$R \leqq 20.9\ M\Omega$$

$$R \leqq 5.1\ M\Omega \text{ or}$$

$$R \leqq 2.0\ M\Omega$$

If the resistance value R of the first resistor device 221 which connects the fifth grid G5 and the sixth grid G6 to each other is set to at least 2.0 MΩ or more, or specifically, if this resistance value is set to 20.9 MΩ, 5.1 MΩ, or 2.0 MΩ or more, the problem of practical phase difference can be solved, so that about 50% of the dynamic focus voltage applied to the sixth grid G6 can be inducted to the fifth grid G5.

Figure 12:
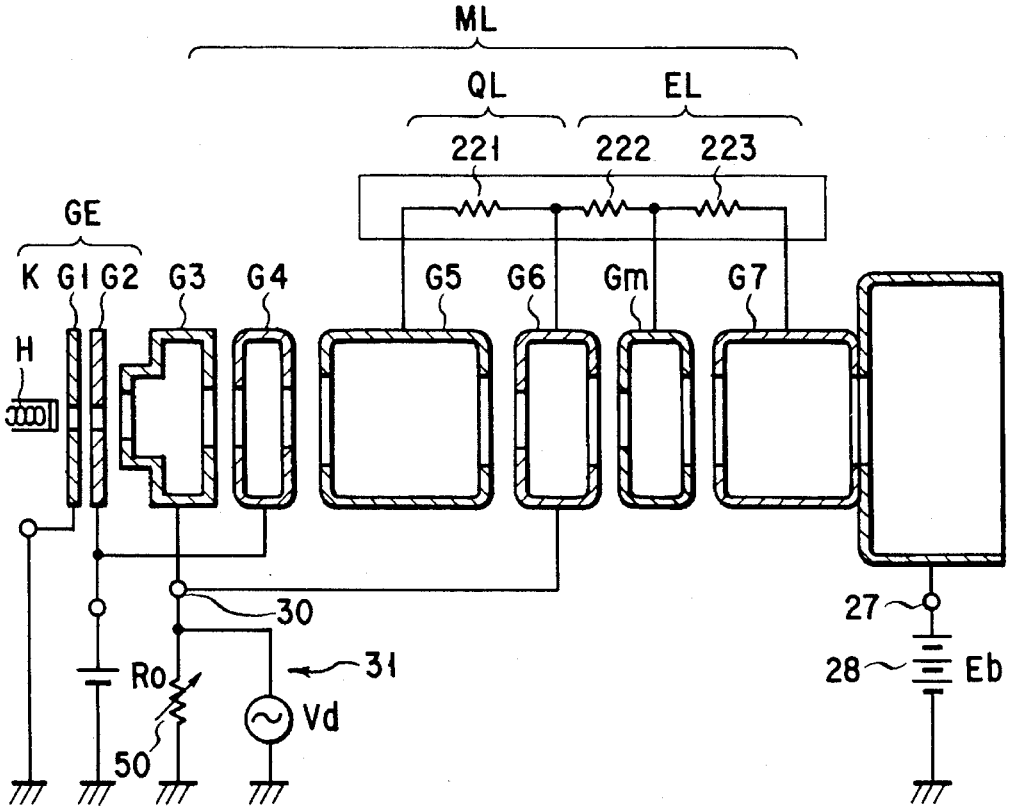
FIG. 12 is a view schematically showing the structure of the electron gun according to further another embodiment of the present invention.

In the next, further another embodiment of the color cathode ray tube apparatus according to the present invention will be explained. FIG. 12 shows the structure of the electron gun according to the embodiment. In the electron gun of this embodiment, a cylindrical intermediate electrode Gm is provided between the sixth grid and the seventh grid of the embodiment shown in FIG. 10, and the electron gun comprises three cathodes K disposed in line in the horizontal direction (i.e., the H-axis direction), a heater H for individually heating the cathodes K, and first to third grids G1 to G3, a fourth grid G4, a fifth grid G5, a sixth grid G6, an intermediate electrode Gm, and a seventh grid G7 which are disposed orderly at a predetermined interval in the direction from the cathode toward the fluorescent screen. The fifth grid G5 and the sixth grid G6 are electrically connected to each other through a first resistor device 221 provided in the tube. The sixth grid G6 and the intermediate electrode Gm are electrically connected to each other by a second resistor device 222, and the intermediate electrode Gm and the seventh grid G7 are connected to each other through a third resistor device 223. Except for these respects, this electron gun has the same structure as that shown in FIG. 6. Therefore, the same portions are referred to by the same references as in FIG. 6, and explanation thereof will be omitted herefrom.

In this electron gun 21, the seventh grid G7 is applied with an anode high voltage Eb of 25 to 35 kV through an anode terminal 31 provided in the funnel. The intermediate electrode Gm is applied with a voltage of 50 to 80% of the anode high voltage Eb, which is obtained in such a manner in which the anode high voltage Eb supplied to the seventh grid G7 is subjected to resistance division by means of the second resistor device 222 connected to the sixth grid G6 and the intermediate electrode Gm. The sixth and third grids G6 and G3 are applied with a voltage of 20 to 35% of the anode high voltage Eb, which is obtained in such a manner in which the anode high voltage Eb is subjected to resistance division by means of the third resistor device 223 connected to the intermediate electrode Gm and the seventh grid G7, and a variable resistor device 50. In particular, the sixth and third grids G6 and G3 are applied with a dynamic focus voltage obtained by superimposing a reference voltage Vf by a parabola-like voltage Vd which changes in synchronization with deflection of the electron beams, wherein the reference voltage Vf is set to a DC voltage of 20 to 35% of the anode high voltage Eb. Note that the fifth, second, and first grids G5, G2, and G1 and the cathodes K are applied with the same voltages as applied in the electron gun according to the embodiment shown in FIG. 6.

Thus, in this electron gun 21, electron emission from the cathodes K is controlled by the cathodes K and the first to third grids G1 to G3, and an electron beam generator section GE is formed which forms electron beams by accelerating and focusing electrons thus emitted. The third to seventh grids G3 to G7 constitute a main electron lens section ML for focusing the electron beams onto the fluorescent screen. In this main electron lens section ML, a multi-pole lens QL is formed between the fifth grid G5 provided with the electron beam through-holes 24*a*, 24*b*, and 24*c* each substantially elongated in the longitudinal direction and the sixth grid G6 having electron beam through-holes 25*a*, 25*b*, and 25*c* each substantially elongated in the lateral direction, and a final focus lens EL is formed between the sixth grid G6 and the seventh grid G7. This final focus lens EL is an electron lens having a large diameter whose electric field is substantially extended, since an intermediate electrode Gm is inserted between the sixth grid G6 and the seventh grid G7.

In the electron gun having a structure as explained above, the multi-pole lens formed between the fifth grid G5 and the sixth grid G6 operates in the same manner as the electron gun according to the embodiment shown in FIG. 10, thereby to correct astigmatic aberration of the deflection magnetic fields. Further, it is possible to allow the multi-pole lens to have a selection operation in accordance with the deflection frequency. In addition, a middle voltage can easily be supplied by connecting the sixth grid G6 to a variable resister device 26 provided outside the tube, costs for a color cathode ray tube apparatus can be greatly reduced. Further, since the final focus lens is arranged to be an electron lens having a large diameter, the spherical aberration is small so that electron beams can excellently be focused onto the fluorescent screen. As a result, it is possible to provide a color cathode ray tube apparatus which ensures high resolution throughout the entire screen, excellent withstanding voltage characteristics, and high reliability.

As for the above embodiments, explanation has been made to a BPF type electron gun using a final focus lens having an axially symmetrical shape and to an electron gun using a final focus lens having an extension electric field type electron lens. However, the present invention is not limited to those electron guns, but is applicable to a color cathode ray tube apparatus comprising an electron gun using another symmetrical electron lens, a non-symmetrical electron lens, or an electron lens formed of a combination of these electron lenses.

According to the present invention, a color cathode ray tube apparatus at least comprises: an electron gun having a main electron lens section formed by a plurality of grids for focusing at least one electron beam emitted from an electron beam generator section; and a deflection yoke for generating a magnetic field for deflecting the electron beam thereby to scan a target with the beam, wherein the electron gun consists of at least one cathode and a plurality of grids, at least adjacent two of the plurality of grids are connected by a resistor device arranged in a tube, a round electron beam through-hole is formed in each of opposing surfaces of the adjacent grids, and at least one of the adjacent grids is applied with a dynamic voltage which changes in synchronization with deflection of the electron beams. Since the electrostatic capacitance between the grids connected by the resistor device, the resistance value of the resistor device, and the frequency of the dynamic voltage synchronized with horizontal deflection are set so as to satisfy a predetermined relationship, astigmatic aberration of a deflection magnetic field can be corrected by merely supplying only one middle voltage from outside the tube. Further, it is possible to allow the multi-pole lens for correcting astigmatic aberration to have a selection function corresponding to the deflection frequency, so that a high performance color cathode ray tube apparatus can be realized which ensures high resolution throughout the entire screen, has excellent withstanding voltage characteristics, and ensures high reliability.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube apparatus for displaying an image on a target, comprising:

electron gun means including:

electron beam generate means for generating electron beams;

focus means having first to fourth electrode structures which form a main electron lens for focusing the electron beams onto the target, an electrostatic capacitance Ca provided between the third and second electrode structures adjacent to each other, and an electrostatic capacitance Cb provided between the second and first electrode structures, each of said electrode structures having apertures for allowing the electron beams to pass; and resistor means having a resistance value R for connecting the adjacent second and third electrodes to each other;

deflection means for generating a magnetic field for deflecting the electron beams emitted from the electron gun means, in horizontal and vertical directions, thereby to scan the target in the horizontal and vertical directions with the electron beams;

high voltage apply means for applying an anode high voltage to the fourth electrode structure;

dynamic voltage apply means for applying a dynamic voltage which changes in synchronization with horizontal deflection of the electron beams, to the third electrode structure, such that a frequency of the dynamic voltage synchronized with the horizontal deflection expressed by fH and a ratio of circumference of a circle to its diameter expressed by $\pi$ satisfy a relation of $$\pi^2 \cdot fH \cdot Ca \cdot R \geqq 13 \cdot (1-\gamma)$$

where $\gamma = Ca/(Ca+Cb)$; and potential maintain means for maintaining the first, second, and third electrode structures at a first, second, and third DC potentials, thereby to form a multi-pole lens for correcting deflection aberration effected on the electron beams between the second and third electrode structures.

2. A cathode ray tube apparatus according to claim 1, wherein the third electrode structure have apertures opposing to the second electrode structure and elongated in the horizontal direction for allowing the electron beams to pass, and the second electrode structure have apertures opposing to the third electrode structure and elongated in the vertical direction for allowing the electron beams to pass.

3. A cathode ray tube apparatus according to claim 1, wherein the electron gun means includes second resistor means connected between the third and fourth electrode structures.

4. A cathode ray tube apparatus according to claim 1, wherein the electron gun means includes a fifth electrode structure arranged between the third and fourth electrode structures, second resistor means connected between the third and fifth electrode structures, and third resistor means connected between the fourth and fifth electrode structures.

5. A cathode ray tube apparatus according to claim 1, wherein an equation of $$\gamma = ga/(ga+gb)$$

is satisfied where ga expresses a distance between the third and second electrode structures corresponding to the electrostatic capacitance Ca and gb expresses a distance between the second and first electrode structures corresponding to the electrostatic capacitance Cb.

6. A cathode ray tube apparatus according to claim 1, wherein a relation of $$R \leqq 20.9\ M\Omega$$

is satisfied where the electrostatic capacitances Ca and Cb are each approximately 2 pF and the horizontal deflection frequency fH is 15.75 kHz.

7. A cathode ray tube apparatus according to claim 1, wherein a relation of $$R \leqq 5.1\ M\Omega$$

is satisfied where the electrostatic capacitances Ca and Cb are each approximately 2 pF and the horizontal deflection frequency fH is 64 kHz.

8. A cathode ray tube apparatus according to claim 1, wherein a relation of $$R \leqq 2.0\ M\Omega$$

is satisfied where the electrostatic capacitances Ca and Cb are each approximately 2 pF and the horizontal deflection frequency fH is 120 kHz.

9. A color cathode ray tube apparatus for displaying an image on a target, comprising:

an electron gun means including:

a cathode for generating electron beams;

focus means having first to seventh grids which form a main electron lens for focusing the electron beams onto the target, an electrostatic capacitance Ca provided between the third sixth and fifth grids adjacent to each other, an electrostatic capacitance Cb provided between the fifth and fourth grids, each of said grids having apertures for allowing the electron beams to pass, the apertures of the fifth grid, which are faced to the sixth grid, being elongated in the vertical direction and the apertures of the sixth grid, which are faced to the fifth grid, being elongated in the horizontal direction; and resistor means having a resistance value R for connecting the adjacent fifth and sixth grids to each other;

deflection means for generating a magnetic field for deflecting the electron beams emitted from the electron gun means, in horizontal and vertical directions, thereby to scan the target in the horizontal and vertical directions with the electron beams;

high voltage apply means for applying an anode high voltage to the seventh grid;

dynamic voltage apply means for applying a dynamic voltage which changes in synchronization with horizontal deflection of the electron beams, to the third and sixth grids, such that a frequency of the dynamic voltage synchronized with the horizontal deflection expressed by fH and a ratio of circumference of a circle to its diameter expressed by $\pi$ satisfy a relation of $$\pi^2 \cdot fH \cdot Ca \cdot R \geqq 13 \cdot (1-\gamma)$$

where $\gamma = Ca/(Ca+Cb)$; and potential maintain means for maintaining the first, second and third grids at different potentials, the second and fourth girds at a same potentials and the third and sixth grids of an another same potentials.

10. A cathode ray tube apparatus according to claim 9, wherein a multi-pole lens for correcting deflection aberration is formed between the fifth and sixth grids.

11. A cathode ray tube apparatus according to claim 9, wherein the electron gun means includes second resistor means connected between the sixth and seventh grids.

12. A cathode ray tube apparatus according to claim 9, wherein the electron gun means includes an additional grids arranged between the sixth and seventh grids, second resistor means connected between the additional and sixth grids, and third resistor means connected between the additional and seventh grids.

13. A cathode ray tube apparatus according to claim 9, wherein an equation of $$\gamma = ga/(ga+gb)$$

is satisfied where ga expresses a distance between the fifth and sixth grids corresponding to the electrostatic capacitance Ca and gb expresses a distance between the fourth and fifth grids corresponding to the electrostatic capacitance Cb.

14. A cathode ray tube apparatus according to claim 9, wherein a relation of $$R \leqq 20.9\ M\Omega$$

is satisfied where the electrostatic capacitances Ca and Cb are each approximately 2 pF and the horizontal deflection frequency fH is 15.75 kHz.

15. A cathode ray tube apparatus according to claim 9, wherein a relation of $$R \leqq 5.1\ M\Omega$$

is satisfied where the electrostatic capacitances Ca and Cb are each approximately 2 pF and the horizontal deflection frequency fH is 64 kHz.

16. A cathode ray tube apparatus according to claim 9, wherein a relation of $$R \leqq 2.0\ M\Omega$$

is satisfied where the electrostatic capacitances Ca and Cb are each approximately 2 pF and the horizontal deflection frequency fH is 120 kHz.

* * * * *